United States Patent [19]

Hunter et al.

[11] 4,101,345

[45] Jul. 18, 1978

[54] GALVANIZING STEEL STRIP IN SELECTED AREAS THEREOF

[75] Inventors: Robert F. Hunter; Stephen R. Koprich; Richard G. Baird-Kerr, all of Burlington; Daniel S. Sakai, Toronto, all of Canada

[73] Assignee: The Steel Company of Canada, Limited, Hamilton, Canada

[21] Appl. No.: 745,000

[22] Filed: Nov. 26, 1976

[30] Foreign Application Priority Data

Nov. 5, 1976 [CA] Canada ..... 264969

[51] Int. Cl.[2] ..... C23C 1/02

[52] U.S. Cl. ..... 148/6.15 R; 148/6.14 R; 148/6.2; 427/282; 427/287; 427/300; 427/329; 427/433

[58] Field of Search ..... 148/6.15 R, 6.2, 6.21, 148/6.14 R; 427/300, 329, 433, 156, 282, 287

[56] References Cited

U.S. PATENT DOCUMENTS

| | | | |
|---|---|---|---|
| 2,137,464 | 11/1938 | Swartz et al. | 148/6.21 |
| 3,104,993 | 9/1963 | Sievert et al. | 148/6.15 R |

*Primary Examiner*—Ralph S. Kendall

*Attorney, Agent, or Firm*—Sim & McBurney

[57] ABSTRACT

Mild steel strip is galvanized in selected areas only, typically on one side only of the strip, by pretreating the areas selected for absence of galvanizing to form thereon a readily chemically strippable coating of chemically hydrated compounds non-wetting in molten zinc. Preferably, the pretreatment is carried out using phosphoric acid solution to form thereon a thin coating of a composite of hydrated iron phosphates and iron hydroxides. After passing the thus-treated steel strip through the molten zinc bath and solidification of the zinc coating, the composite coating is removed by dilute mineral acid. Mild steel strip galvanized on one side using this procedure has particular utility in the automotive industry.

6 Claims, 1 Drawing Figure

GALVANIZING STEEL STRIP IN SELECTED AREAS THEREOF

FIELD OF INVENTION

This invention relates to the galvanizing of steel strip.

BACKGROUND TO THE INVENTION

Galvanized steel has been proposed to be used in the automotive industry to provide improved corrosion resistance for specific components. Unfortunately, the gloss of painted zinc surfaces and mild steel are difficult to match.

It has, therefore, been proposed to provide the zinc coating on the intended inner surface only of the steel strip, thereby allowing painting of the exterior steel metal surface in conventional manner.

Various suggestions have been made for producing a selectively galvanized product, but none to date has been entirely commercially satisfactory from an economic standpoint. Prior art suggestions have included electrolytic zinc deposition on one side only of the steel strip, melt coating of zinc on one side only of the steel strip using sophisticated mechanical coating apparatus, hot-dip galvanizing the steel strip on both sides in conventional manner and subsequently removing the coating from one side of the strip using acid, and providing some sort of barrier layer on the side of the sheet on which zinc is not desired to prevent wetting of that side during the galvanizing of the steel strip, the barrier layer subsequently being removed or left in contact with the steel strip, depending on the coating concerned.

SUMMARY OF INVENTION

In accordance with the present invention, there is provided on the mild steel surface which is not to be galvanized a readily chemically strippable coating of chemically hydrated compounds non-wetting in molten zinc. The chemically hydrated compound results from a spontaneous reaction of the ferrous metal with inorganic acids.

By forming the coating on the mild steel surface, prior to galvanizing, zinc is prevented from being adhered to the coated surface. The coating may be removed immediately after galvanizing or may be left in contact with the mild steel surface during storage for later removal prior to finishing of the surface.

GENERAL DESCRIPTION OF INVENTION

While the invention has particular applicability to and will be described with particular reference to the galvanizing of one side only of mild steel strip in a continuous operation, the invention may be used for the selective galvanizing of desired areas of any form of steel sheet or strip by the formation of the coating on those areas of the steel which do not require galvanizing.

The chemical form of the coating depends on the nature of the aqueous treatment solution used. Generally, the treatment solution includes inorganic acids and treatment therewith usually is carried out under oxidizing conditions. The coating usually is composed of hydrated iron compounds, usually iron hydroxides, and hydrated iron salts of the acids used. Other salts may be present in the coating depending upon the cations present in the treating solution.

Examples of inorganic acids which may be used are solutions of phosphates, permanganates, chromates, molybdates or silicates. Owing to their ready availability and effectiveness, phosphoric acid-containing treating solutions are preferred, generally containing about 5 to about 50 g/l of total phosphate.

The formation of the preferred coating layer in accordance with this invention usually is achieved by contacting the surface of the steel on which the coating is to be formed with a phosphoric acid and sodium phosphate solution having an acid pH at a temperature above about 140° F.

Oxidizing agents, such as nitrites and chlorates, may be added to the treating solution to accelerate the rate of coating deposition.

The treatment solution used preferably is a diluted form of a commercially-available phosphate solution concentrate, such as a Parker "Bonderite," Pennwalt "Fosbond," an Amchem "Granodine" or an Enthone "Enthox."

The contact time depends on the weight of the coating desired, the mode of contact used and in any event is very short. The coating usually has a weight of less than about 50 mg/sq.ft. of surface, preferably in the range of about 20 to 40 mg/sq.ft. Coating weights of this order of magnitude have been found to be satisfactory in preventing wetting of the coated surface by molten zinc in the galvanizing step and hence, in preventing adherence of zinc to the coated surface. Coating weights of this order of magnitude may be achieved by contact times of only 1 to 2 seconds at about 150° F between the treatment solution and the mild steel surface, using spray or dip application.

Where roll application is used, a more acidic solution may be required to achieve the required coating weight.

The coating layer which is provided in this preferred embodiment of the invention is a composite of a hydrated iron phosphate and iron hydroxide, such as a composite of $Fe_3(PO_4)_2 \cdot 8H_2O$ and $Fe(OH)_3$, particularly in the proportions of about 60% of the iron phosphate and 40% of the ferric hydroxide.

The coating layer may be removed from the galvanized strip after conventional adhesion of zinc to the uncoated surface and cooling to provide a clean steel surface indistinguishable from the initial mild steel surface and to which paint may be applied by conventional automobile painting techniques.

Removal of the preferred composite layer is achieved in rapid manner by mild acid treatment thereof. One preferred removal operation involves contacting the coating layer with dilute hydrochloric acid, such as about 1 to about 10% HCl, preferably about 3 to 4% HCl, at an elevated temperature in the range of about 110° to about 180° F, preferably about 150° to about 160° F. One beneficial side effect of the acid removal treatment is an apparent smoothing of the mild steel surface, thereby providing an improved surface for painting.

The ready and rapid formation and removal of the coating layer and its effectiveness in preventing adhesion of zinc to treated surfaces allows incorporation of the treatment and removal operations into a conventional continuous steel strip galvanizing operation without the necessity of expensive equipment, time-consuming operations, or significant disruption to the normal operating parameters of the operation.

BRIEF DESCRIPTION OF DRAWING

The sole FIGURE of the accompanying drawings is a schematic representation of a continuous steel strip galvanizing operation utilizing the present invention.

DESCRIPTION OF PREFERRED EMBODIMENT

Figure 1:
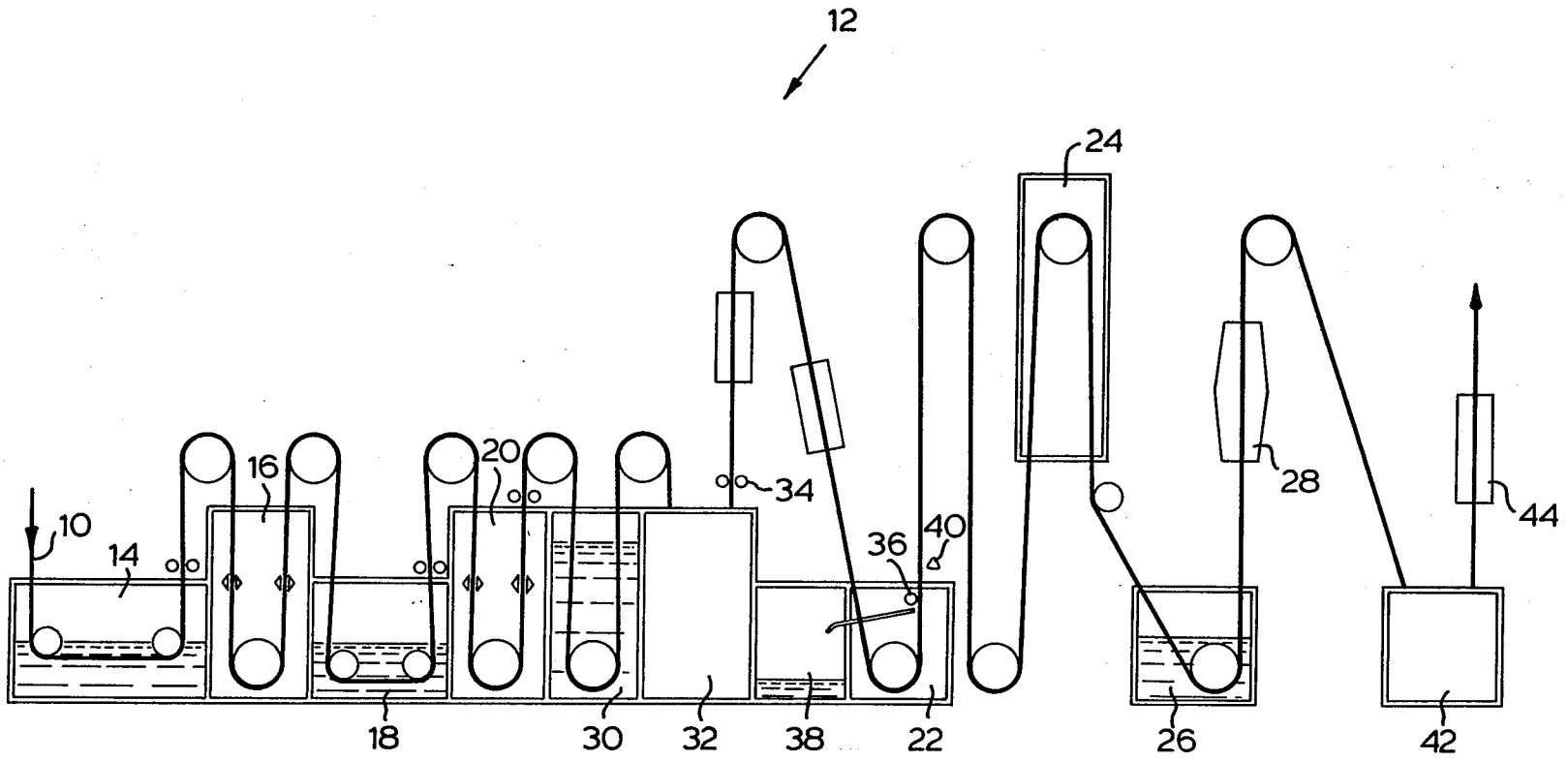

Referring to the drawing, continuous mild steel strip 10 is passed through a one-side galvanizing line 12, typically at the speed of a conventional continuous galvanizing line, to form a zinc coating on one side only of the steel strip. The majority of the operations carried out on the steel strip are conventional to continuous galvanizing operations and will be familiar to those skilled in the art, including cleaning the strip by successive passage through a hot alkaline bath 14, spray rinser 16, acid pickling bath 18 and spray rinser 20 and galvanizing the cleaned strip by successive passage through a fluxing bath 22, a preheating chamber 24, a galvanizing bath of molten zinc 26 and a cooling chamber 28. Conventional components and operations are used and further description thereof is unnecessary.

In accordance with the present invention, modifications are made to the conventional continuous galvanizing line to ensure the application of the zinc coating to one side only of the steel strip 10, in place of the conventional two-side application. Thus, immediately after rinsing in spray rinser 20 and before fluxing in the fluxing bath 22, the steel strip 10 passes through a preheater 30, which may be in the form of a bath of hot water, such as at a temperature of about 200° F. Alternatively, the preheater 30 may be in the form of a hot water spray applicator, and may also fulfil the purpose of rinsing, thereby eliminating the need for spray rinser 20.

Thereafter, the preheated strip passes through a treatment chamber 32 wherein it is treated with acid solution to form a coating of a composite or a barrier coating on the side which is not required to be galvanized, such as by spray application with diluted Parker 901 concentrate.

Residual surface liquid from the treatment solution application is removed by air doctors or rubber wringer rolls 34 prior to passage of the coated strip to the fluxing operation. Following application of the flux to the non-treated side of the strip by sparger 36, excess flux flows into collecting tank 38, and flux runaround at the edges and any residual solution from the treatment is removed from the barrier-coated side by spray washer 40.

Following passage of the strip 10 through the galvanizing bath 26 and the cooler 28, the metal strip, which now has zinc coated on one side and the coating layer coating on the other side, passes through a coating layer stripper 42 wherein dilute hydrochloric acid contacts the coating layer, to remove the coating layer. The strip is rinsed and then passes through a drier 44 to remove residual moisture.

Application times of the steel strip 10 in the treatment chamber 32 and the coating layer stripper 42 are very short at the conventional speed of a galvanizing line, typically up to about 2 seconds, but these contact times are effective for the formation and removal of the coating layer.

Following the drying of the strip 10 in drier 44, the strip may be coiled for shipment and use. If it is desired to ship the strip with the coating layer in contact therewith, the strip 10 may be coiled as it exits the cooler 28. Roller levelling may be practised just prior to coiling in order to decrease the yield point elongation of the steel.

The mild steel surface of the one-side galvanized strip resulting from this operation is physically indistinguishable from the initial strip, and reacts identically to normal cold rolled steel with respect to painting pretreatments, such as zinc phosphating, indicating that the operations of formation of the coating and subsequent removal thereof do not adversely affect the mild steel surface.

This invention, therefore, permits the formation of one-side galvanized steel sheet suitable for automotive use in a convenient manner. External mild steel surfaces in automobile components formed from such sheet may be painted in conventional manner, with good matching with other painted mild steel surfaces.

EXAMPLES

The invention is illustrated by the following Examples:

EXAMPLE 1

Steel panels measuring 3 by 8 inches and having a thickness of 0.033 inches were initially prepared by the following successive operations:

i. degreased using condensing trichloroethylene;

ii. cleaned by dipping in an alkali cleaner, "Oakite 20", at 180° F and at a concentration of 30 g/l for about 5 seconds;

iii. rinsed in hot water at 170° F for about 3 seconds;

iv. pickled in 12% by weight hydrochloric acid at room temperature; and v. rinsed in water under various conditions.

Thereafter, coatings were formed on the panels by application of various treating solutions for short periods of time, followed by rinsing of the panels at 140° F for about 6 seconds. In each case, the coatings were found to consist of hydrated iron compounds.

Following measurement of the thickness of the coating layer, the uncoated side then had a zinc ammonium chloride flux applied thereto in a concentration of 75 g/l at 180° F.

After drying the fluxed panels at 450° F for 30 seconds, the panels were dipped in a zinc bath having an aluminum concentration of 0.12% by weight at 860° F for about 10 seconds to form a zinc coating on the untreated side. Thereafter, the panels were examined for adhesion of zinc to the initially coated side.

Thereafter, the galvanized panels having a temperature of 200° F were treated with 2% by weight hydrochloric acid at a temperature of 160° F for about 5 seconds. After rinsing and drying, the galvanized panels were observed and found to have one side coated with zinc and the other side exhibiting a mild steel surface substantially indistinguishable from the initial surface.

The results of the various tests are reproduced in the following Table:

TABLE

| Run No. | Rinsing Conditions after Pickling Temp. ° F | Rinsing Conditions after Pickling Time Sec. | Barrier Coating Application Technique | Barrier Coating Concentration of Solution | Barrier Coating Temp. ° F | Barrier Coating Time Secs. | Barrier Coating Time Delay in air prior to Rinsing Sec. | Barrier Coating Thickness mg/ft.$^2$ | % Zn on Barrier coated side | % Zn on Fluxed Side |
|---|---|---|---|---|---|---|---|---|---|---|
| 1 | 200 | 6 | Dip | 11.8% by vol.(1) | 160 | 1.5 | 5 | 30.0 | 0 | 100 |
| 2 | 59 | 6 | Spray | " | 140 | 1.5 | 4 | 28.8 | 0 | 100 |
| 3 | 59 | 6 | " | " | 150 | 1.5 | 4 | 30.9 | 0 | 100 |
| 4 | 59 | 6 | " | " | 165 | 1.5 | 4 | 29.1 | 0 | 100 |
| 5 | 59 | 6 | " | " | 180 | 1.5 | 4 | 25.9 | 0 | 100 |
| 6 | 59 | 6 | " | 6.25% by vol.(1) | 150 | 1.5 | 4 | 30.6 | 0 | 100 |
| 7 | 59 | 6 | " | " | 165 | 1.5 | 4 | 29.9 | 0 | 100 |
| 8 | 59 | 6 | " | " | 180 | 1.5 | 4 | 27.7 | 0 | 100 |
| 9 | 140 | 6 | Roll | (2) | 140 | 0.02 | 4 | 46.7 | 0 | 100 |
| 10 | 140 | 6 | Dip | (3) | 120 | 5 | 5 | ~2.0 | 0 | 100 |
| 11 | 140 | 6 | None | No coating | | | | | 15 | 100 |

Notes: (1)% by vol. of Parker 901
(2)11.8% by vol. of Parker 901 + 23 ml/l of 85% $H_3PO_4$ + 0.2 g/l of $NaClO_3$
(3)55 g/l of $Cr_2O_3$, 0.35 g/l of $H_2SO_4$ and 0.24 g/l of $HBF_4$ The results of the above Table demonstrate that, under laboratory test conditions, coatings consisting of hydrated compounds are effective in preventing zinc from adhering to non-fluxed surfaces and are readily removed after galvanizing. In particular, the coatings produced from Parker 901 are very effective at coating weights of about 25 to 30 mg/ft.$^2$.

EXAMPLE 2

Steel of commercial bottle top grade was batch annealed, temper rolled to a #5 finish without oiling and then slit into coils having a strip width of 12 inches. This material was fed continuously to a pilot plant processing line at a rate of 60 ft./min.

The processing received by the steel strip in the line consisted of the following sequential steps:

i. alkaline cleaning using "Oakite 20" at 180° F and at a concentration of 36 g/l for 12 seconds;

ii. cold water rinsing for about 4 seconds;

iii. pickling in hydrochloric acid at 70° F at a concentration of 12% by weight for about 6 seconds;

iv. cold water spray rinsing for about 4 seconds;

v. hot water dipping at 200° F for 7 seconds;

vi. dipping in Parker 901 Bonderite solution at 160° F and at a concentration of 11.8% by volume for about 1.5 seconds, with appropriate masking to treat one side only of the strip;

vii. air wiping of excess solution from the surface and drying with hot air at a temperature of about 250° F. The time between dipping in the solution and complete drying of the coating was about 6 seconds;

viii. zinc ammonium chloride fluxing of the non-treated side by use of a low pressure spray at a concentration of 75 g/l and a flux temperature of 185° F;

ix. spray rinsing of the non-fluxed side at a water flow rate of about 2 imp.gallons/min. and a water temperature of 118° F;

x. air wiping of both sides and drying with hot air at about 250° F for about 4 seconds;

xi. heating the steel to about 450° F in an electrically heated oven in about 18 seconds;

xii. dipping in molten zinc containing 0.12% aluminum at a temperature of 860° F for about 4.8 seconds;

xiii. wiping both sides of the strip upon emerging from the zinc bath with steam superheated to a temperature of 500° F;

xvi. cooling and solidifying the zinc coating using cold air impingement for 7 seconds;

xv. stripping the non-zinc coated side by contacting the surface with 2% by weight hydrochloric acid at a temperature of 140° F for 2 seconds, with minimization of attack of zinc coated side by the hydrochloric acid;

xvi. cold water spray rinsing of both sides before the acid wet strip dried for a total spray time of 5 seconds;

xvii. air wiping and hot air drying of the strip at a temperature of about 250° F for 4 seconds, and xviii. recoiling of the strip.

The above-described sequence of process steps resulted in a zinc free surface of mild steel and zinc coated side having conventional hot dip galvanize spangle characteristics. The zinc coating had excellent adhesion and coating weights were in the range of 0.26 to 0.46 oz/ft.$^2$. The zinc coated side had bare edges of up to 0.25 inches.

The non-zinc coated side was found to react identically to normal cold rolled steel with respect to painting pretreatments, such as zinc phosphating. The surface finish of the non-zinc coated side was not found to have significantly altered during the process.

Therefore, in continuous pilot plant operation, the coating rapidly produced from Parker 901 on the mild steel surface effectively prevents the galvanizing of the so-treated side of the steel strip. The coating was readily removed from the one-side galvanized strip and the coating and subsequent removal operations did not adversely affect the mild steel strip surface.

EXAMPLE 3

The procedure outlined in Example 2 was repeated, except that in this instance the pretreatment step (vi) was omitted.

The non-fluxed side of the strip was found to have a generally spotty zinc pick up with a zinc coated edge of approximately 0.5 to 0.8 inches in width.

Thus, when the non-fluxed side of the sheet is left bare, sporadic pick up of zinc occurs, which is considered unsatisfactory where a wholly mild steel surface is required on the non-galvanized side.

EXAMPLE 4

The procedure outlined in Example 2 was repeated on a commercial galvanizing line of the Cook-Norton design. Steel strip of up to 38 inches in width and 0.042 inches in thickness was processed on this line.

In this instance, however, the treatment solution was applied by transfer from a rubber roller and the solution had the composition used in Run 9 of Example 1. A minimum elapsed time of 5 seconds before rinsing was allowed with no force drying during this period.

The steel strip produced thereby exhibited similar properties to the steel strip processed in Example 2, except that the edge effect on the zinc-coated side tended to be more variable, ranging from 0 up to 3 inches.

The coating applied, therefore, was very effective in preventing galvanizing of the so-treated side of the steel sheet under continuous production line conditions. The coating was readily removed following completion of the galvanizing.

It is possible, therefore, to incorporate the coating and removal operations into a conventional commercial galvanizing line and obtain one-side galvanized mild steel strip without affecting the speed of operation of the galvanizing line.

SUMMARY

The present invention, therefore, provides a convenient and simple-to-use procedure for formation of zinc coatings on selected surfaces only of mild steel. Modifications are possible within the scope of the invention.

What we claim is:

1. In a method of galvanizing only selected areas of a ferrous metal strip, the improvement which comprises contacting surface areas of said strip not to be galvanized with a phosphoric acid solution to cause a spontaneous reaction to form a readily chemically strippable coating of a composite comprising iron hydroxides and hydrated iron phosphates non-wetting in molten zinc on said surface areas not to be galvanized, and passing the so-treated strip through said molten zinc with the coating in contact with said molten zinc.

2. In the continuous galvanizing of steel strip wherein steel strip is continuously cleaned, pickled, fluxed and galvanized, the operations, after said pickling and before said fluxing, of contacting one side only of said strip with an inorganic acid medium containing phosphoric acid to form on said one side only a coating comprising iron hydroxides and hydrated iron phosphates, and washing said coating substantially free from any excess unreacted inorganic acid medium, whereby, upon said galvanizing, the coating on said one side and the side of said strip opposite to said one side contact molten zinc and, after said galvanizing, a continuous steel strip is formed having a galvanized coating only on the side thereof opposite to said one side.

3. The process of claim 2 including the further step of, after said galvanizing, removing said coating with a dilute hydrochloric acid solution.

4. The process of claim 2 wherein said inorganic acidic medium has a total phosphate concentration of about 5 to about 50 g/l and said treatment includes preheating said steel strip and contacting said one side only of said preheated steel strip with said acidic medium at a temperature greater than about 140° F to form said coating thereon.

5. The process of claim 4 including the further step of, after said galvanizing, removing said coating by contacting said one side only of said steel strip with dilute hydrochloric acid of concentration about 1 to about 10% at a temperature of about 110° to about 180° F.

6. The process of claim 5 wherein said temperature is about 150° to about 160° F and said concentration is about 2 to 4%.

* * * * *